US006308668B2

(12) United States Patent
Nitkiewicz et al.

(10) Patent No.: US 6,308,668 B2
(45) Date of Patent: Oct. 30, 2001

(54) METHOD FOR STARTING AN ELECTROMECHANICAL REGULATING DEVICE ESPECIALLY DESIGNED FOR CONTROLLING THE CHARGE CYCLE IN AN INTERNAL COMBUSTION ENGINE

(75) Inventors: James Nitkiewicz, Regensburg; Volker Warnecke, Nittendorf; Hanspeter Zink, Regensburg, all of (DE)

(73) Assignees: Siemens Aktiengesellschaft AG, Munich (DE); Siemens Automotive Corp, Auburn Hills, MI (US)

( * ) Notice: Subject to any disclaimer, the term of this patent is extended or adjusted under 35 U.S.C. 154(b) by 0 days.

(21) Appl. No.: 09/748,808

(22) Filed: Dec. 26, 2000

Related U.S. Application Data

(63) Continuation of application No. PCT/EP99/04387, filed on Jun. 24, 1999.

(30) Foreign Application Priority Data

Jun. 26, 1998 (DE) ..... 198 28 612

(51) Int. Cl.[7] ..... F01L 9/04

(52) U.S. Cl. ..... 123/90.11; 251/129.16; 361/191

(58) Field of Search ..... 123/90.11; 251/129.01, 251/129.15, 129.16; 361/191

(56) References Cited

U.S. PATENT DOCUMENTS 5,671,705 9/1997 Matzumoto et al. ..... 123/90.11
5,742,467 4/1998 Schmitz ..... 361/154
5,799,630 * 9/1998 Moriya et al. ..... 123/90.11
5,915,347 * 6/1999 Yanai et al. ..... 123/90.11
6,176,208 * 1/2001 Tsuzuki et al. ..... 123/90.11

FOREIGN PATENT DOCUMENTS

3307070C2 11/1985 (DE) .
19518056A1 11/1996 (DE) .

OTHER PUBLICATIONS

Japanese Patent Abstract No. 11093711 (Toshio), dated Apr. 6, 1999.

* cited by examiner

*Primary Examiner*—Weilun Lo
(74) *Attorney, Agent, or Firm*—Herbert L. Lerner; Laurence A. Greenberg; Werner H. Stemer

(57) ABSTRACT

A method for starting an electromechanical regulating device especially designed for controlling the charge cycle in an internal combustion engine. The electromechanical regulating device has an actuating element and an actuating drive. The actuating drive includes a first electromagnet with a first coil and a second electromagnet with a second coil, an armature which can move between contact faces of the first and second electromagnets, and at least one restoring means which is mechanically coupled to the armature. To start the regulating device, the second coil is energized until a first predefined condition is fulfilled and then the first coil is energized from the time at which a second condition is fulfilled until the armature comes into contact with the contact face.

7 Claims, 2 Drawing Sheets

METHOD FOR STARTING AN ELECTROMECHANICAL REGULATING DEVICE ESPECIALLY DESIGNED FOR CONTROLLING THE CHARGE CYCLE IN AN INTERNAL COMBUSTION ENGINE

CROSS-REFERENCE TO RELATED APPLICATION

This is a continuation of copending International Application PCT/EP99/04387, filed Jun. 24, 1999, which designated the United States.

BACKGROUND OF THE INVENTION

Field of the Invention

A known regulating device (DE 33 07 070 C2) has an actuating element, which is embodied as a charge cycle valve, and an actuating drive. The actuating drive has two electromagnets between which an armature plate of an armature is mounted so as to be movable counter to the force of a restoring means. In order to start the regulating device, i.e. to move the armature from a static position of rest into a position of contact with one of the electromagnets, the coils of the electromagnets are excited in the vicinity of the natural frequency of the spring/mass system to oscillate with increasing amplitude. This method is, however, unreliable at very low temperatures (for example<−20° C.) and if the static position of rest of the armature is different from its geometric center position between the contact faces of the two electromagnets.

Summary of the Invention

It is accordingly an object of the invention to provide a method for starting an electromechanical regulating device which overcomes the above-mentioned disadvantages of the prior art methods of this general type, and which is independent of operating and ambient conditions.

With the foregoing and other objects in view there is provided, in accordance with the invention a method for starting an electromechanical regulating device. The method includes providing an electromechanical regulating device having an actuating element and an actuating drive; providing the actuating drive with a first electromagnet which has a contact face and a first coil; providing the actuating drive with a second electromagnet which has a contact face and a second coil; providing the actuating drive with an armature which can move between the contact face of the first electromagnet and the contact face of the second electromagnet; and providing the actuating drive with at least one restoring device which is mechanically coupled to the armature. The method includes defining a first position that is located separate from an open position and from a closed position on one of the contact faces. A first condition is defined as being satisfied if the armature has reached the first position; The second coil is energized until the first condition is satisfied. The first coil is energized from a time at which a second condition is fulfilled until the armature comes into contact with the contact face of the first electromagnet.

The invention is characterized in that first the second coil is energized until a first predefined condition is fulfilled, and then the first coil is energized from the time at which a second condition is fulfilled until the armature comes into contact with the contact face of the first electromagnet.

The advantages of the invention come into play in particular if the actuating element is embodied as an outlet valve of an internal combustion engine. The static position of rest of the armature is then advantageously adjusted from the geometric center position to the open position of the outlet valve. The outlet valve can thus be opened more easily counter to the forces of the gases in the cylinder of the internal combustion engine.

Other features which are considered as characteristic for the invention are set forth in the appended claims.

Although the invention is illustrated and described herein as embodied in a method for starting an electromechanical regulating device especially designed for controlling the charge cycle in an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
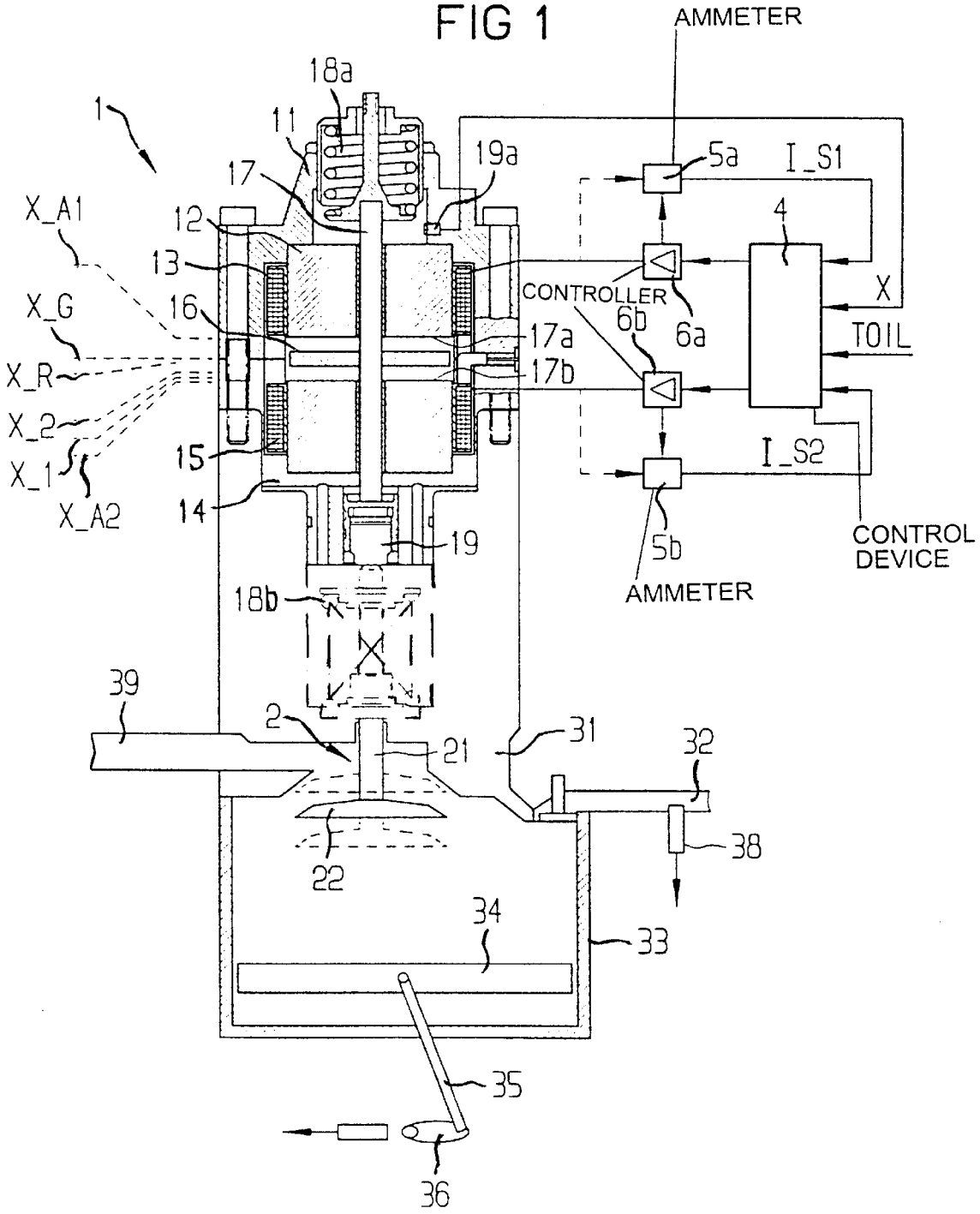
FIG. 1 shows a configuration of a regulating device in an internal combustion engine.

Referring now to the figures of the drawing in detail and first, particularly, to FIG. 1 thereof, there is shown a regulating device that includes an actuating drive 1 and an actuating element 2. The actuating element 2 is embodied, for example, as a charge cycle valve and has a shaft 21 and a plate 22. The actuating drive 1 has a housing 11 in which a first and a second electromagnet are configured. The first electromagnet has a first core 12 in which a first coil 13 is embedded in an annular groove. The second electromagnet has a second core 14 in which a second coil 15 is embedded in a further annular groove. An armature is provided whose armature plate 16 is configured in the housing 11 so as to be movable between the contact faces 17*a*, 17*b* of the first and second electromagnets. The armature also includes an armature shaft 17 which is guided through cutouts in the first and second cores 12, 14 and which can be coupled to the shaft 21 of the actuating element 2 via a hydraulic play-compensating element 19. The hydraulic play-compensating element 19 compensates for manufacturing inaccuracies of the armature, of the electromagnets, of the first restoring means 18*a* and the second restoring means 18*b* of the actuating element 2, and of the cylinder head 31. The play-compensating element 19 is connected to the oil circuit of the internal combustion engine. The hydraulic pressure in the play-compensating element 19 is set by means of an oil pump (not illustrated) while the internal combustion engine is operating. If the internal combustion engine is not operating, the oil pressure drops away, which leads to a static position of rest X_R of the armature plate 16 being reset from a geometric center position X_G of the armature plate 16 to an open position X_A2. The first restoring means 18*a* and the second restoring means 18*b* prestress the armature plate 16 into the position of rest X_R. The restoring means 18*a,* 18*b* are preferably embodied as springs.

The regulating device is rigidly connected to a cylinder head 31. The cylinder head 31 is assigned an intake duct 32 and a cylinder 33 with a piston 34. The piston 34 is coupled to a crank shaft 36 via a connecting rod 35. An exhaust duct 39 is also assigned to the cylinder head 31. In this exemplary embodiment, the actuating element 2 is embodied as an outlet valve. However, it may also be embodied as an inlet valve of the cylinder 33.

A control device 4 is provided which detects signals from sensors and generates actuating signals as a function of which the first or the second coil 13, 15 of the regulating device is actuated by power controllers 6*a,* 6*b*. The sensors are embodied as a first ammeter 5*a* which detects a current through the first coil 13 or a current in the power controller 6*a,* or as a second ammeter 5*b* which detects the current through the second coil 15 or the current in the power controller 6*b*. In addition, a position sensor 19*a* is configured in the housing 11, which detects the position of the armature, and thus that of the armature plate 16. Further sensors may also be provided in addition to the aforementioned sensors.

In the control device 4, a regulator which regulates the current through the respective coil 13, 15 to a predefined set point value is provided for each of the coils 13, 15. The regulator is preferably embodied as a two-point regulator. If the first coil 13 and the second coil 15 are not energized for longer than a predefined time period (for example five seconds)—this is the case, for example, in the operating state in which the internal combustion engine is stopped—the armature plate 16 is in its position of rest X_R. The position of rest X_R is displaced from the geometric center position X_G to the open position X_A2. This has the advantage that when the regulating device is operating, the armature plate 16 can be moved more easily and with greater force in the direction of the open position X_A2. This ensures more reliable opening of the actuating element 2, which is embodied as an outlet valve, counter to the strong forces of the gases in the cylinder 33. If the oil pressure in the oil circuit of the internal combustion engine drops, as is the case for example in the operating state in which the internal combustion engine is stopped because of the deactivated oil pump, the position of rest X_R of the armature plate 16 is displaced further in the direction of the open position X_A2. When the internal combustion engine starts, all the charge cycle valves (inlet and outlet valves) must firstly be placed in the position which closes the cylinder. When the internal combustion engine starts, the regulating device is also started. When the regulating device starts, energization of the second coil 15 is controlled by the control device 4 until a first predefined condition is fulfilled. The first coil 13 is then energized from the time at which a second condition is fulfilled until the armature comes into contact with the contact face 17*a* of the first electromagnet and can be held against the face 17*a*. The first condition is preferably that the armature has reached a predefined first position X_1 in which the supplied potential energy is sufficient to move, by converting the potential energy into kinetic energy, its position in the direction of the closed position X_A1 to the extent that the force which is brought about by the energization of the first coil 13 and is exerted on the armature plate 16 is sufficient to bring the armature plate 16 into contact with the contact face 17*a,* i.e. to move it into the closed position X_A1.

The second condition is preferably that the armature has reached a predefined second position X_2. The second position X_A2 can very easily be identical with the first position X_1. However, it can advantageously also be between the first position X_1 and the position of rest X_R, as a result of which the power loss of the first coil 13 is reduced.

The power loss in the first coil 13 is at a minimum if the second position X_2 is approximately in the position of rest X_R. The predefined first and second positions X_1, X_2 can be permanently predefined, that is to say can be determined for example by trials on a test bench. If the first position X_1 and/or the second position X_2 depends on the temperature TOIL of the oil of the oil circuit, the energy required to attract the armature plate 16 to the closed position X_A1 can be supplied to the armature very precisely because the energy depends essentially on the viscosity of the oil. In a different embodiment of the invention, the first and second positions X_1, X_2 depend on the time profile of the movement of the armature. For this purpose, the position of the armature is detected at permanently predefined time intervals and the locations at which the first and/or second positions X_1, X_2 must be in order to reliably bring the armature plate 16 into contact with the contact face 17*a* are derived from the speed profile.

Figure 2A:
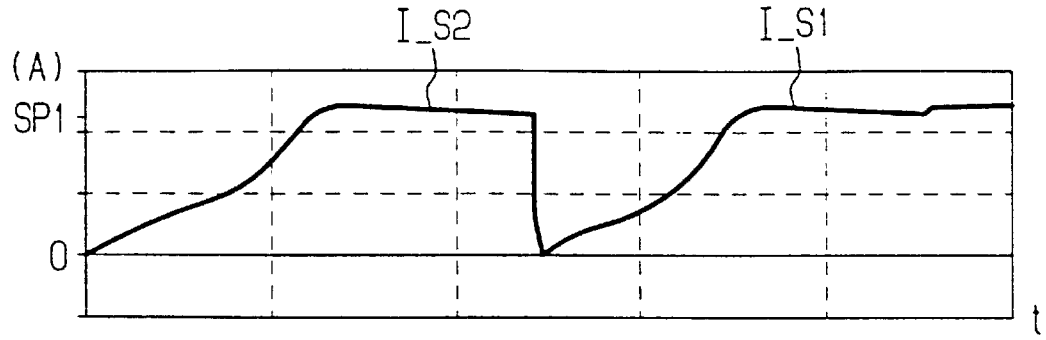
FIG. 2A shows the current I_S1 through the first coil and the current I_S2 through the second coil as functions of time.
Figure 2B:
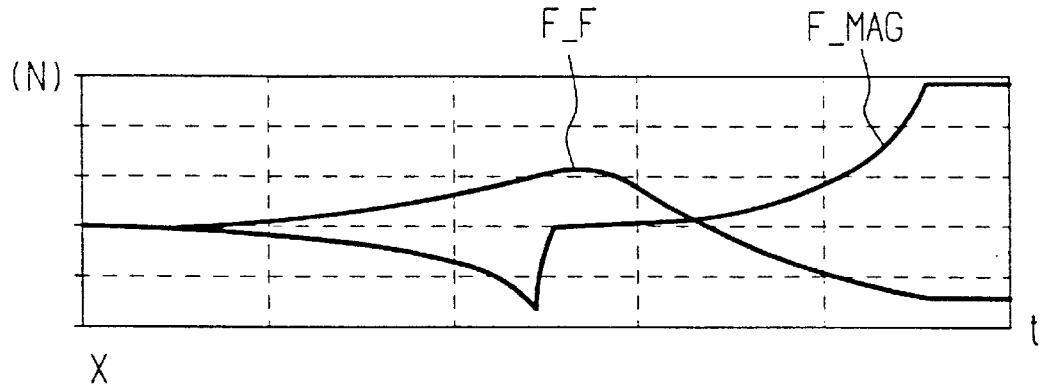
FIG. 2B shows a spring force F_F and an electromagnetic actuating force F_MAG as a function of time.
Figure 2C:
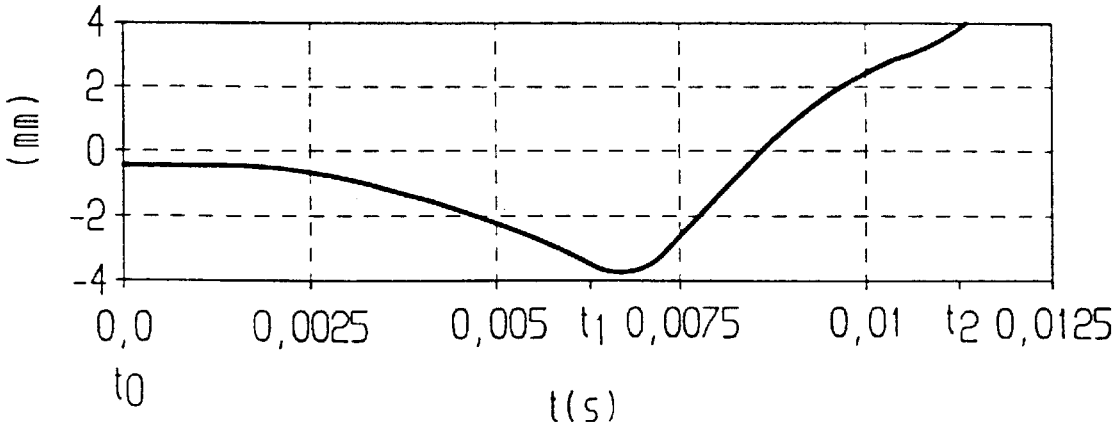
FIG. 2C shows the position X of the armature plate as a function of time.

FIG. 2*a* shows the time profile of the current I_S1 and I_S2 through the first coil 13 and through the second coil 15 plotted against time t. FIG. 2*b* shows the profile of the spring force F_F which is brought about by the restoring means 18*a, b,* and the profile of the electromagnetic actuating force F_MAG plot ted against time t. FIG. 2*c* shows the profile of the position X of the armature plate 16 plotted against the time t. The scale of the time axis of the FIGS. 2*a,* 2*b,* 2*c* is the same in each case.

The starting process of the regulating device begins at a time $t_0$. The current I_S2 through the second coil 15 is regulated to a first set point value SP1 up to a time $t_1$. At the time $t_1$, the armature plate 16 has reached the first position X_1. The set point value of the current I_S2 through the second coil is set to zero amperes starting from this time. At the same time, the set point value of the current I_S1 through the first coil 13 is set to the first set point value SP1 until the armature plate 16 has reached the closed position X_A1 at the time $t_2$. After the time $t_2$, the set point value of the current I_S1 through the first coil is set to a hold value which is predefined in such a way that the electromagnetic actuating force F_MAG which is brought about is sufficient to hold the armature plate 16 in the closed position X_A1.

We claim:

1. A method for starting an electromechanical regulating device, which comprises:

providing an electromechanical regulating device having an actuating element and an actuating drive;

providing the actuating drive with a first electromagnet which has a contact face and a first coil;

providing the actuating drive with a second electromagnet which has a contact face and a second coil;

providing the actuating drive with an armature which can move between the contact face of the first electromagnet and the contact face of the second electromagnet;

providing the actuating drive with at least one restoring device which is mechanically coupled to the armature;

defining a first position located separate from an open position and from a closed position on one of the contact faces;

defining a first condition as being satisfied if the armature has reached the first position;

energizing the second coil until the first condition is satisfied; and energizing the first coil from a time at which a second condition is fulfilled until the armature comes into contact with the contact face of the first electromagnet.

2. The method according to claim 1, which comprises defining the second condition as a state when the armature has reached a predefined second position.

3. The method according to claim 2, wherein the second position is between the first position and a position of rest.

4. The method according to claim 2, wherein:

the armature is in a position of rest before the electromechanical regulating device starts; and the second position is approximately the position of rest.

5. The method according to claim 1, which comprises defining the first position as a function of a temperature of oil.

6. The method according to claim 1, which comprises defining the first position dependent upon a movement of the armature with respect to time.

7. The method according to claim 2, which comprises defining the second position dependent upon a movement of the armature with respect to time.

* * * * *